United States Patent [19]

Agbay et al.

[11] Patent Number: 4,619,370

[45] Date of Patent: Oct. 28, 1986

[54] TAMPER RESISTANT AND TAMPER EVIDENT CLOSURES

[75] Inventors: Albert J. Agbay, Worcester, Mass.; Ralph H. Thomas, Sr., Clark, N.J.

[73] Assignee: Robert Linkletter Associates, Ltd., Union, N.J.

[21] Appl. No.: 703,334

[22] Filed: Feb. 20, 1985

Related U.S. Application Data

[62] Division of Ser. No. 591,541, Mar. 20, 1984, Pat. No. 4,519,514.

[51] Int. Cl.[4] ..... B65D 55/02

[52] U.S. Cl. ..... 215/225; 215/217

[58] Field of Search ..... 215/217, 218, 220, 221, 215/224, 225, 253

[56] References Cited

U.S. PATENT DOCUMENTS

| | | | |
|---|---|---|---|
| 3,581,925 | 6/1971 | Thornton et al. | 215/225 |
| 3,757,979 | 9/1973 | Berghahn | 215/225 |
| 3,811,589 | 5/1974 | Thornton et al. | 215/225 |
| 3,901,400 | 8/1975 | Westfall | 215/225 |

*Primary Examiner*—George T. Hall

*Attorney, Agent, or Firm*—Blakely, Sokoloff, Taylor & Zafman

[57] ABSTRACT

Safety closures resistant to (and evidencing) tampering comprising a snap cap or screw cap, a rotary safety ring, and a tear tab attached to the neck of the container, said closure requiring that the tear tab be removed before the safety ring can be lowered; the safety ring must be aligned with the cap in one angular position and pushed downwardly away from the cap before the cap can be removed from the container. These safety closures may include a tear pin, attached to the cap and to the ring, which must be broken before the cap can be removed from the container; the tear pin may be in addition to, or an alternative for, the tear tab. The tear pin and tear tab are made to be removable. This invention describes a tamper resistant and tamper evident closure comprising a cap having a depending annular flange with a slot therein, and an outwardly directed wing protruding through said slot; the cap cannot be removed without causing the cap to shear off the outwardly directed wing, which is made to be removable. This invention describes a tamper resistant and tamper evident closure comprising a screw cap having an engaging surface located next to a projecting member attached to the neck of the container so that the engaging surface will always shear off the projecting member, which is made to be removable, when the screw cap is first removed from the container.

6 Claims, 23 Drawing Figures

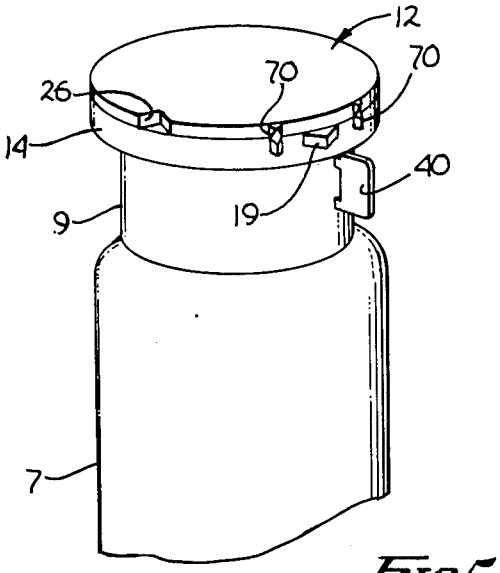
Fig. 5
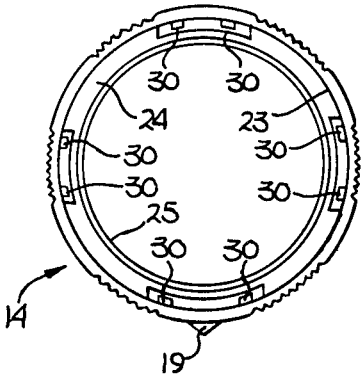
Fig. 6
Fig. 7
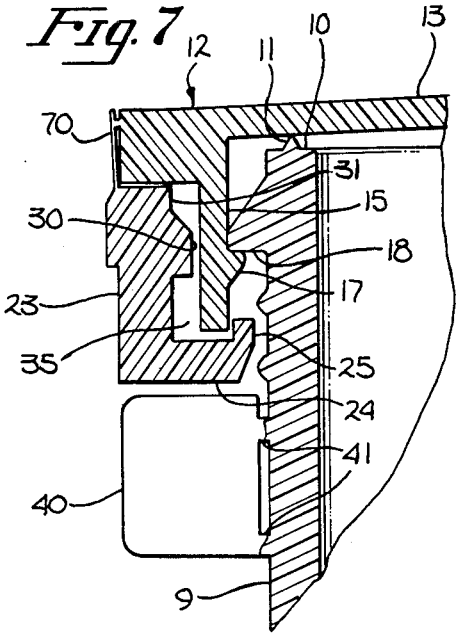
Fig. 8
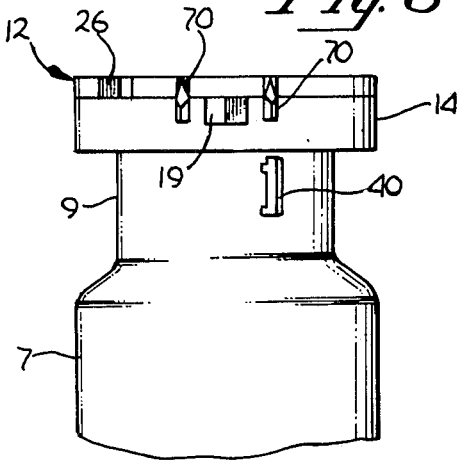

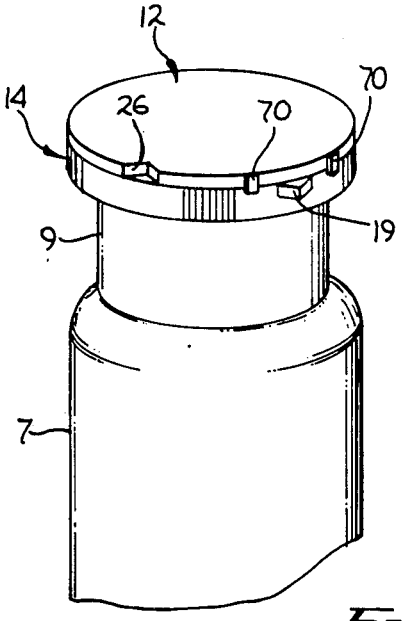
Fig. 9
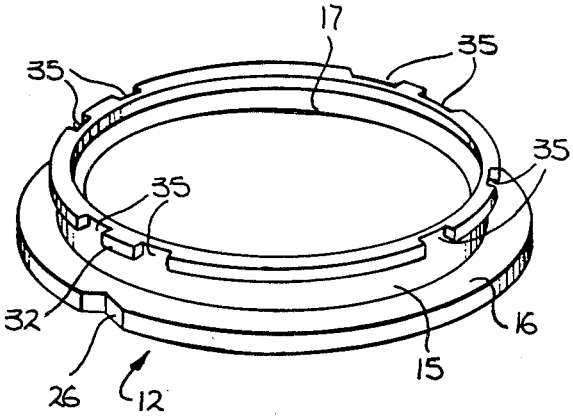
Fig. 10
Fig. 11
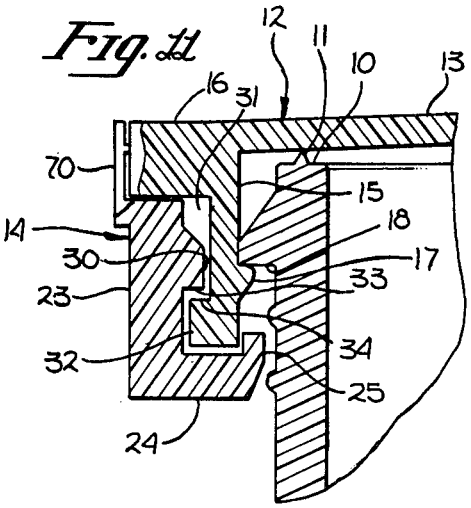
Fig. 12
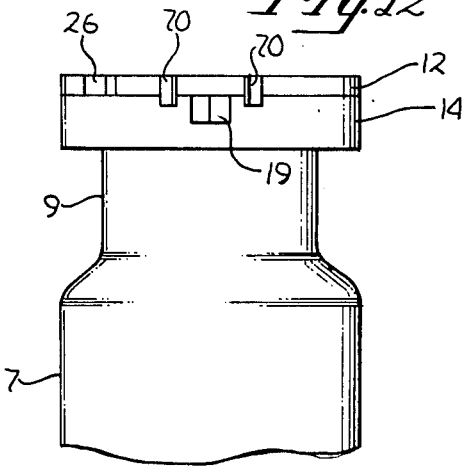

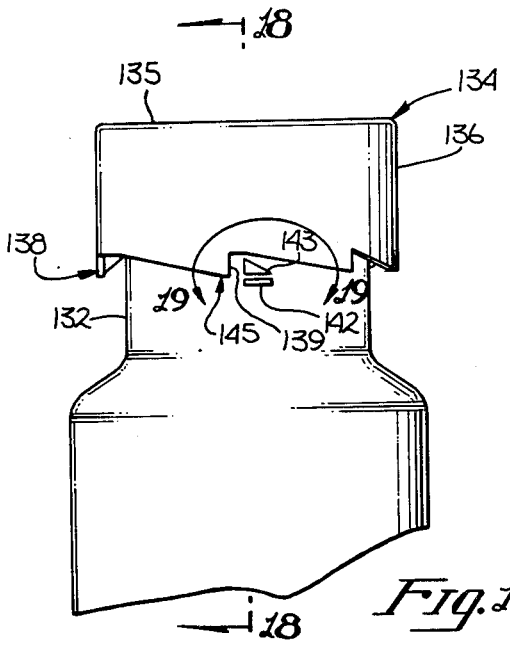
Fig. 17
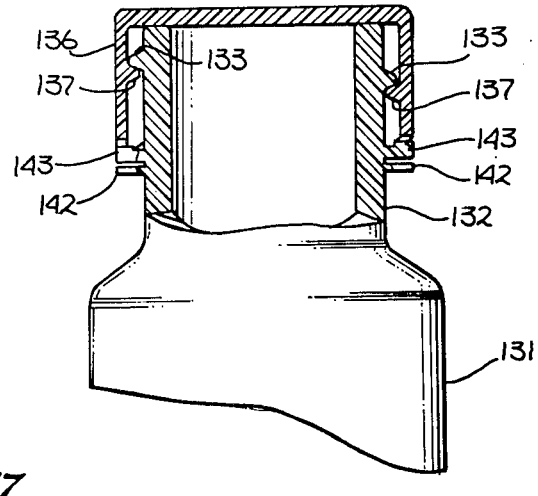
Fig. 18
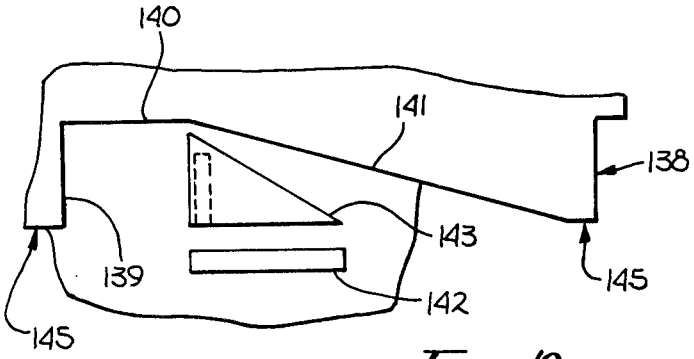
Fig. 19
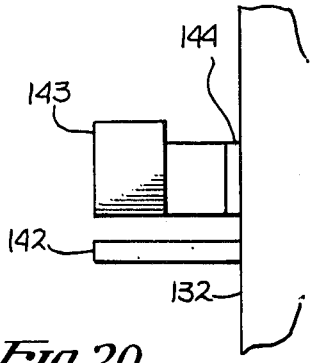
Fig. 20
Fig. 21
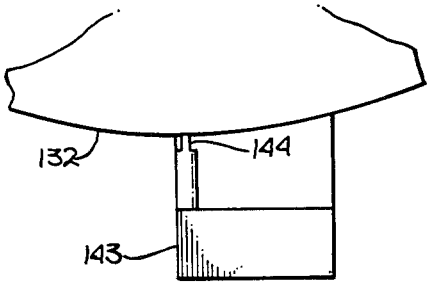
Fig. 22a
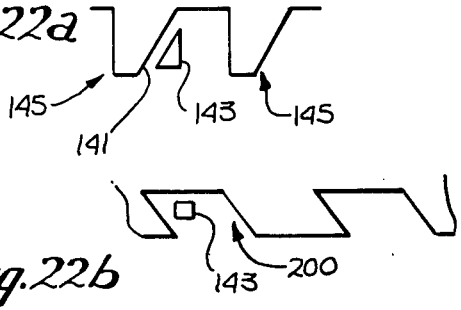
Fig. 22b

TAMPER RESISTANT AND TAMPER EVIDENT CLOSURES

This is a (divisional) of application Ser. No. 591,541 filed Mar. 20, 1984; now U.S. Pat. No. 4,519,514.

BACKGROUND OF THE INVENTION

1. Field of the Invention

This invention relates to safety closure containers and has particular reference to closures having tamper resistant and tamper evident features. Some of the closures disclosed herein are also child resistant closures in that they tend to prevent children from readily opening the containers.

2. Prior Art

Various safety closures are described in the prior art, such as the safety closures disclosed in U.S. Pat. Nos. 3,612,322 and 3,693,820. These safety closures comprise a snap on cap held in place on a container by a rotary safety ring which must be aligned with the cap and pushed downwardly away from the cap before one can remove the cap from the container. There is only one angular position in which the rotary ring can be removed from the cap. The ring is locked around a portion of the cap by fingers, which extend from either inside of the ring or from the cap, and which fingers fit into a locking groove formed between the ring and cap. The ring is unlocked by aligning it with the cap in one angular position so that the fingers slide through release grooves in the locking groove when the ring is pulled downwardly away from the cap.

While these safety closures have generally worked well, they are particularly prone to tampering because the consumer has no way of knowing whether the container has been opened or otherwise tampered with. It is an object of this invention to provide closures which are resistant to tampering and provide evidence of tampering.

SUMMARY OF THE INVENTION

The present invention provides a safety closure having a snap-on cap ("snap cap") (or a "screw-on cap"—"screw cap") held in place on a container by a rotary safety ring which must be aligned with the cap in one angular position and pushed downwardly away from the cap before one can remove the cap from the container. The ring is locked around a portion of the cap by fingers, which usually extend from the inside of the ring, and which fingers fit into a locking groove formed between the ring and the cap. The ring is unlocked by aligning it with the cap in one angular position so that the fingers slide through release grooves in the locking groove when the ring is pulled downwardly away from the cap. The present invention includes a tear tab which is attached to the neck of the container below the safety ring. The tear tab is attached so that it may be removed by, for example, forcefully lowering the safety ring. Generally, however, the consumer would remove the tear tabs by twisting them off. The tear tab prevents the safety ring from being lowered and therefore keeps it in a locked position around the cap. Hence, the tear tab will keep the closure from being opened unless the tear tab is removed. Thus, a missing tear tab on a container will indicate that the bottle has been opened or otherwise tampered with; the closure with a tear tab becomes both tamper evident and tamper resistant.

Another feature of the present invention provides a tear pin connected between the cap (either snap cap or screw cap) and the safety ring. The pin connects the cap and ring when they are in the locked position, and preferably when the ring and cap are out of alignment. The pin is made so it will tear easily when, for example, the ring is rotated relative to the cap. Since the pin holds the cap and ring locked, the cap and ring cannot be unlocked without breaking the pin. Thus, a broken pin will indicate that the closure has been tampered with or opened; hence, the closure is tamper evident. This tear pin may be used alone, or in conjunction with the tear tabs. Furthermore, since this pin provides resistance on first opening the closure, the pin makes the closure tamper resistant.

Another embodiment of the present invention provides simple and effective means for indicating and resisting tampering of the closure and container. This embodiment provides a cap which has a top and a depending annular flange projecting below the top, which depending annular flange overlies a portion of the neck of the container and has a slot, through which an outwardly directed wing protrudes. The outwardly directed wing is completely surrounded by the slot, and the bottom edge of the slot will always abut the bottom edge of the wing when the cap is removed. Thus, the wing will prevent the cap from being removed unless the wing can be easily removed from the neck. The wing is attached to the neck so that it can be sheared off when one attempts to lift the cap off the container. Thus, the closure can not be opened or otherwise tampered with without shearing off the wing. Again, a missing wing will indicate that the bottle has been opened or otherwise tampered with.

This invention also provides a tamper evident and tamper resistant safety closure having a screw cap. A projecting member extending from the neck of the container is normally juxtaposed (i.e., placed side by side or close to) to an engaging surface on the screw cap. When the screw cap is unscrewed to remove the cap from the container, the engaging surface abuts the projecting member, which is fragilely attached to the neck so that it will be sheared off when the engaging surface is forcefully pushed onto the projecting member. Thus, the projecting member will indicate whether the closure has been tampered or opened. The following detailed description, together with drawings, will illustrate by way of example the features and advantages of the present invention.

DESCRIPTION OF THE DRAWINGS

FIG. 5 illustrates, in an elevated side view, a safety closure including both the tear tabs 40 and the tear pins 70.

FIG. 6 is a top view of the rotary safety ring 14.

FIG. 7 is a cross-sectional view of the safety closure shown in FIG. 5.

FIG. 8 is a side view of the safety closure shown in FIG. 5.

FIG. 9 illustrates an elevated side view of a safety closure having the tear pins 70.

FIG. 10 shows the cap 12 in a view from the underside of the cap.

FIG. 11 shows the safety closure of FIG. 9 in a cross-sectional view.

FIG. 12 is a side view of the safety closure shown in FIG. 9.

FIG. 17 is a side view of the safety closure 130.

FIG. 18 is a cross-sectional view of the safety closure shown in FIG. 17, that view taken as indicated in FIG. 17.

FIG. 19 is an enlarged side view of the area around the projecting member 143.

FIG. 20 is an enlarged view of the projecting member 143.

FIG. 21 shows an enlarged top view of the projecting member 143.

FIGS. 22(*a*) and 22(*b*) shows two types of teeth styles for use with the safety closure 130.

DETAILED DESCRIPTION OF THE INVENTION

Figure 2:
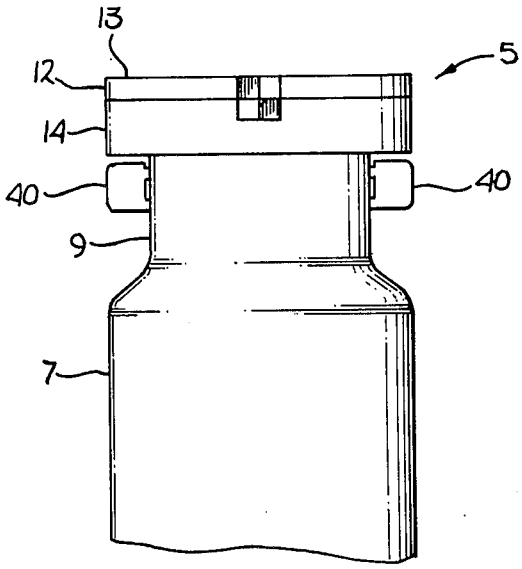
FIG. 2 is a side view of the safety closure 5.
Figure 3:
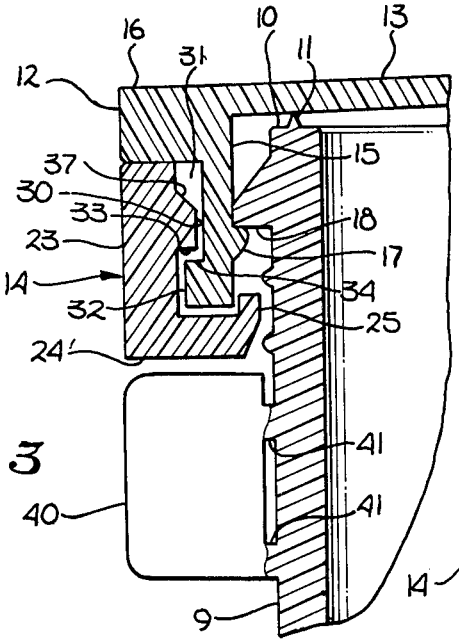
FIG. 3 is a cross-sectional view of safety closure 5 showing the tear tab 40; it also illustrates that the cap and ring are out of alignment.

Referring to FIGS. 2 and 3, the safety closure 5, designed for a container 7 having a neck 9 and a rim 10 defining an open mouth, generally comprises a flexible snap-on cap (snap cap) 12 covering the mouth of the container and a rotary safety ring ("safety ring") 14 which holds the cap on the container when the ring overlies a portion of the cap.

To better define this invention, the following words will be explained. Longitudinal (and longitudinally), as used to describe and claim this invention, means along the length of the container; that is, along a line extending from the cap, through the ring and down through the neck to the bottom of the container. This line is a vertical line when the container sits normally on its bottom on a flat surface. Lateral (and laterally), as used to describe and claim this invention, means along the width of the container; that is, along a line extending from one point of the cap, or ring, or container, to a diametrically opposed point on the cap, or ring, or container, respectively. These lines are horizontal when the container sits normally. Vertical is sometimes used in place of longitudinal, and horizontal is sometimes used in place of lateral. The term "container" includes glass bottles, paper containers, molded plastic containers (e.g., thermoplastic, laminated plastic containers), metal collapsible tubes, thermosetting plastic containers, metal containers and similar containers having a neck and a rim defining an open mouth.

Referring primarily to FIGS. 2, 3, 6 and 10 the cap 12 has a top 13 overlying the rim 10 of the container 7 and a depending annular flange (depending flange) 15 which projects downwardly from the top and surrounds an upper portion of the neck 9. An outwardly projecting radial flange 16 is the portion of the top of the cap which extends beyond the depending annular flange 15. Near the lower end of the depending flange 15 is an inwardly directed circumferential bead 17 which engages a peripheral lip 18 surrounding the rim 10 when the cap is secured to the container. The peripheral lip 18 projects outwardly around the rim of the container and, together with the inwardly directed circumferential bead 17 of the depending flange 15, forms an interfitting means between the cap and container. The cap 12 is attached to the container 7 by pressing the cap downwardly over the rim 10, which causes the depending flange 15 to flex outwardly to allow the inwardly directed circumferential bead 17 to slip over the peripheral lip 18 of the container and to flex inwardly back towards its original position, where it engages the peripheral lip 18. In this position, the inwardly directed circumferential bead 17 is juxtaposed below the peripheral lip 18. The cap 12, when attached to the container 7, presses against the extension 11 of the rim 10, thereby providing a seal. The depending flange 15 is preferably made of a flexible material.

Figure 1:
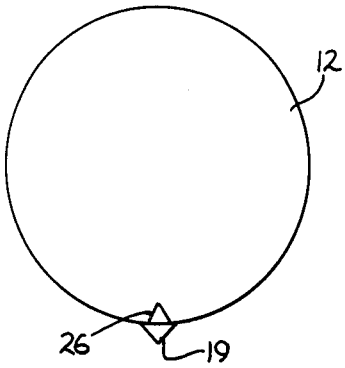
FIG. 1 is a top view of the safety closure 5.

The safety ring 14 normally surrounds the depending annular flange 15 to block outward flexing of the depending flange, and thereby prevents the inwardly directed circumferential bead 17 from slipping over the peripheral lip 18 when one attempts to lift the cap 12. Vertical serations completely around the safety ring 14 may be added to make it easier to grip the ring. The safety ring 14 generally has a L-shaped vertical cross section, as shown in FIG. 3. The tab 19 of the safety ring, as shown in FIGS. 1 and 2, forms an outwardly projecting lateral wall of the safety ring. The generally L-shaped vertical cross section of the safety ring is formed by an annular sidewall 23 and an inwardly projecting bottom wall 24 which extends almost to the neck 9 of the container 7. The inwardly projecting bottom wall 24 generally does not touch the neck 9 of the container 7. The sidewall 23 encircles the depending flange 15 of the cap when the closure is locked, and the bottom wall 24 strengthens the sidewall and assists in positioning the safety ring on the container. The bottom wall 24 also prevents the safety ring from sliding off the neck of the container by engaging the peripheral lip 18 when the safety ring slides down the neck, as it does when the container is tilted to remove the container's contents. As shown in FIG. 3, an upwardly projecting flange 25 may be provided on the inner end of the bottom wall to help keep the safety ring around the neck of the container.

To remove the cap 12 from the container 7, the safety ring must be precisely aligned in a preselected position relative to the cap 12. The tab 19 of the safety ring and the notch 26 of the cap may be used to indicate when the safety ring is precisely aligned in the preselected angular position ("one angular position") relative to the cap. For example, when the notch 26 overlaps the tab 19, as shown in the embodiment depicted in FIG. 2, the safety ring 14 is precisely aligned with the cap 12 so that the safety ring can be pushed downwardly away from the cap. The safety ring can be pushed downwardly away from the cap only when the ring is precisely aligned with the cap. Thus, the safety ring of the container shown in FIG. 5, being out of alignment with the cap 12 cannot be pushed downwardly away from the cap. Hence, this container is "locked"; that is, the safety ring is locked around the cap and the cap cannot be removed from the container. Furthermore, the safety ring cannot be removed from the cap.

Once the safety ring is moved from its position around the depending flange 15 by slipping the safety ring downwardly off the cap onto the neck 9 of the container, the cap 12 can be lifted off the container 7 since the depending flange 15 is now free to flex upwardly. As one pulls the cap up, the outward flexion of the depending flange 15 permits the inwardly directed circumferential bead 17 to slip around the peripheral lip 18. When the container 7 is to be closed, the cap 12 is pressed back onto the neck 9, so that the inwardly directed circumferential bead 17 slips around and under the peripheral lip 18. Then, the safety ring is raised back into the locked position so that the annular sidewall 23 encircles the depending flange 15 of the cap 12. The safety ring can be raised back into the locked position in any angular position with the cap; no alignment of cap and safety ring is necessary to place the safety ring back onto the cap because the fingers which are described below and which hold the ring around the cap, are flexible. It is preferable that the safety ring be flexible also.

As shown in FIGS. 3 and 11, the safety ring locks around the depending flange by at least one, and preferably several, resiliently flexible fingers 30 which may be angularly spaced about the inside of the annular sidewall 23. The safety ring shown in FIGS. 3 and 6, has eight such fingers 30. The angularly spaced, flexible fingers 30, connected at one end to the inside of the annular sidewall 23 of the safety ring 14, project inwardly into a circumferential locking groove 31 formed around the depending flange 15 of the cap 12 to lock the ring in position around the cap. The locking groove 31 is defined by a first outwardly directed circumferential bead 32 located near the bottom of the depending flange 15, the outwardly projecting radial flange 16 of the top 13 and a longitudinal portion of the depending flange 15. On the screw cap version of these closures, the locking groove is formed by a longitudinal portion of the depending flange 15, the first outwardly directed circumferential bead 32 and the second outwardly directed circumferential bead 43.

As shown in FIGS. 3 and 11, the fingers 30 project inwardly into the locking groove 31 when the safety ring 14 is in place around the depending flange 15 and have free inner ends 33 which overlie an upwardly facing shoulder 34 which forms the bottom wall of the locking groove 31. The fingers 30 closely approach the outer longitudinal portion of the depending flange 15. The upwardly facing shoulder 34 defines the top of the first outwardly directed circumferential bead 32. Thus, if a downward force is applied to the ring 14 when the fingers 30 overlie the upwardly facing shoulder 34 (and thus overlie the first outwardly directed circumferential bead 32), the resulting downward motion of the fingers 30 relative to the shoulder 34 wedges the free ends 33 of the fingers 30 downwardly into the shoulder. This longitudinal wedging of the fingers 30 against the shoulder 34 prevents further downward movement of the safety ring since such movement can occur only if the fingers buckle longitudinally, which requires an extremely large force. Such a force would generally deform the safety ring so much that it would break. Accordingly, the fingers 30 and the locking groove 31 hold the ring in place around the cap by keeping the ring positioned around the depending annular flange 15. Thus, the ring is locked around the cap. Furthermore, if the safety ring is not aligned in the preselected angular position in which the safety ring may be removed from the cap, the cap cannot be removed from the container.

To allow the fingers 30 to move out of the locking groove 31 when the safety ring 14 is to be unlocked (for the removal of the cap 12), a number of longitudinally extending release grooves 35, shown in FIGS. 7 and 10, are formed in the outer side of the depending flange 15 between the locking groove 31 and lower end of the flange. The number of release grooves should be equal to the number of fingers 30 on the safety ring. Thus, the depending flange 15, designed to work with the safety ring 14 depicted in FIG. 3 and 6 has eight release grooves. The number of release grooves could vary depending upon the size of the closure. The release grooves 35 extend from the locking groove 31 through the upwardly facing shoulder 34 to the lower longitudinal end of the depending flange 15. The fingers 30 and the release grooves 35 are formed in a special manner (by size and spacing them to match each other) to prevent downward movement of the ring except in one angular position of the ring with regard to the cap, thus limiting the release of the cap to that one position. Preferably, the fingers 30 and the associated release grooves 35 are of different sizes so that the safety ring 14 is releasable in only one angular position. Each of the release grooves 35 is to be aligned with the particular matching finger, which alignment occurs in the one preselected angular position when the longitudinally extending release grooves 35 will permit the fingers 30 to slide through and thereby release the safety ring from the cap.

As used to describe and claim this invention, alignment means that the safety ring is angularly placed relative to the cap so that it may be released by sliding the fingers 30 through the longitudinally extending release grooves 35. Thus, when the safety ring is out of alignment with the cap, the safety ring can not be removed from the cap by pushing it downwardly away from the cap. The word "locked" as used to describe and claim this invention, means that the safety ring is positioned around the cap, whether or not the safety ring is aligned with the cap, so that the annular sidewall 23 surrounds the depending annular flange 15 and the fingers 30 are located in the locking groove 31. Thus, the closure is unlocked whenever the safety ring has been moved downwardly away from the cap so that the annular sidewall no longer surrounds the depending annular flange 15, and the fingers 30 are no longer located in the locking groove.

Each of the release grooves 35 is slightly larger than its associated finger 30 and, when properly aligned with the finger, will permit it to slide from the locking groove 31 through the release groove 35 in the first outwardly directed circumferential bead 32 and off the cap 12.

Once the ring 14 has been slipped off the cap 12 (i.e. the ring is no longer locked around the cap), the cap can be pulled or snapped off the container 7 to allow dispensing of its contents. To replace the cap 12 and lock it in position on the container 7, the cap is snapped over the rim 10 and the ring 14 is pushed upwardly into position around the depending flange 15. Since the fingers 30 are flexible and incline inwardly, and have an upper edge 37 which is inclined downwardly, no prealignment of the fingers in the release grooves 35 is necessary. When the safety ring 14 is moved upwardly with the fingers 30 out of alignment with the release grooves 35, the first outwardly directed circumferential bead 32 of the depending flange 15 flexes the fingers 30 and annular sidewall 23 of the safety ring outwardly. The outward deflection occurs as the upper edge 37 of the fingers slides over the first outwardly directed circumferential bead 32. Then, as the safety ring 14 reaches the fully seated position in which the top of the annular sidewall 23 approaches the underside of the top 13 of the cap 12, the fingers are aligned in the locking groove, thereby locking the safety ring 14 to the cap. Thus, the safety ring can be returned into locking position around the cap without aligning it with the cap. It should be noted that the ring and cap form an assembly when the ring is locked around the cap.

The fingers 30, as illustrated in FIGS. 3 and 6, have generally rectangular cross sections and are integrally joined to the safety ring 14. In addition, a plurality of recesses may be formed in the annular sidewall, such recesses being aligned with the fingers to receive them substantially flush with the annular sidewall as the safety ring is moved back upwardly onto the cap (i.e. locking the ring onto the cap). Alternatively, the fingers may be formed as cutouts from the annular sidewall 23 of the safety ring 14, such cutouts being integrally joined to the safety ring at their upper ends, and a plurality of recesses being formed from the spaces from which the fingers were cut.

Figure 4:
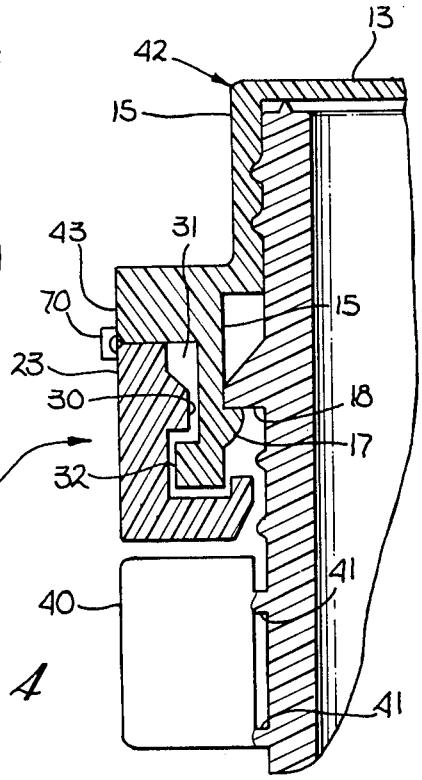
FIG. 4 shows the safety closure 5 using a screw cap 42 rather than the snap cap 12; this Figure is a cross-sectional view.
Figure 13:
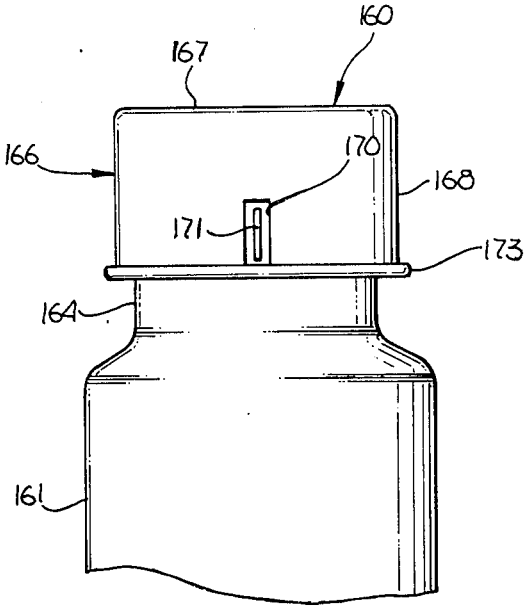
FIG. 13 shows, in a side view, the safety closure 160.
Figure 14:
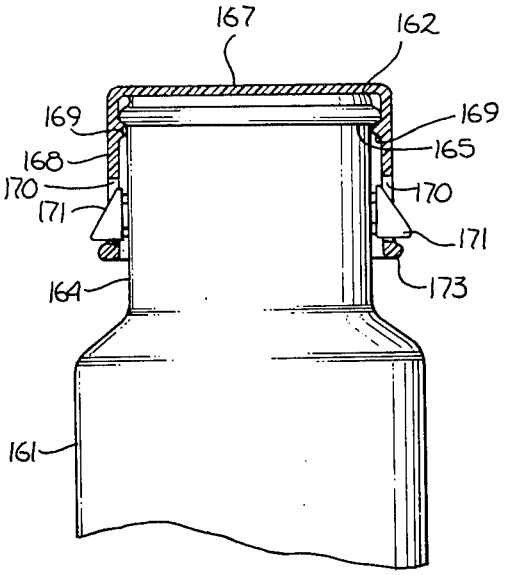
FIG. 14 is a cross-sectional view of the safety closure 160.

As illustrated in FIGS. 2, 3 and 4, this invention provides a tear tab 40, located on the neck 9 below the safety ring 14, which prevents the safety ring from being unlocked (i.e., pushed downwardly away from the cap) as long as the tab is attached to the neck. As illustrated in FIG. 3, the tear tab 40 is attached to the neck 9 by two small pegs 41, which are thin enough so that the tab can be removed from the neck by tearing it off, bending it or otherwise applying force to the tab. The pegs 41 are part of the neck 9; only one peg 41 may be used to attach the tear tab 40 to the neck. If the pegs 41 are made thin enough, the tear tab 40 can be removed from the neck merely by unlocking the ring from the cap; that is, the tear tab will be torn off the neck by lowering the safety ring away from the cap. Generally, however, the tear tabs may be twisted off the neck by the consumer prior to lowering the safety ring.

Preferably, the tear tab 40 is placed closely below the bottom portion of the safety ring, so that the safety ring will always abut the top portion of the tear tab when one attempts to unlock the safety ring from the cap. Two tear tabs 40 may be placed on one container. Generally, it is preferable that the two tear tabs 40 be placed 180 degrees from each other; that is, the two tabs are placed diametrically opposite each other around the neck 9.

As shown in FIG. 3, the safety ring 14 may not be lowered away from the cap 12 without causing the safety ring 14 to abut the upper portion of the tear tab 40. If the consumer is instructed that the container has been tampered with or opened if the tear tab is not in place (or one of the pegs 41 has been broken), then the tear tab becomes a way to prevent tampering of the contents of the container 7. Thus, the tear tab 40 makes the closure both tamper evident and tamper resistant because tampering will be evidenced by the missing tear tab (or broken peg 41) and that tear tab also provides resistance on first opening the container. In accordance with this invention, the tear tab 40 may be attached in many ways. Thus, one peg 41 may be provided. Alternatively, a long, slender spline that is flexible may be used to attach the tear tab 40 to the neck 9; the spline would be placed between the neck and the tear tab 40. Of course, the attachment of the tear tab 40 must be sturdy enough that the tear tab 40 will not be removed from the neck (or otherwise appear that the closure has been tampered with) by normal handling (e.g., packaging) of the container. To prevent removal of the tear tab 40 during normal handling, one could make the tear tab extend outwardly (from the neck) less than the outer diameter of the bottle and the safety ring.

While it is preferable to place a tear tab 40 closely below the bottom edge of the annular sidewall 23, the present invention will properly function as long as the tab 40 is positioned on the neck so that the safety ring 14 will always abut it before it can be unlocked from the cap. The tear tab 40 may have any geometry. For example, the tear tab may resemble a washer (i.e., flat, annular flange) which could completely surround the neck below the safety ring; this type of tear tab is especially useful for glass containers with the safety closure 5.

The tear tab 40 may also be used on a closure, similar to the one described above, but having a screw cap rather than a snap cap. Referring to FIG. 4, a safety closure of the general type described above is illustrated, wherein the safety closure includes a screw cap rather than a snap cap. The screw cap 42 has a top 13 overlying the mouth and the rim 10, and has a depending annular flange 15 projecting below the top 13. The container 7 includes a screw means for engaging the screw cap 42. As is well known in the art, there are various ways to provide screw means for engaging the screw cap as well as corresponding means on the screw cap for engaging the container. For example, a helical thread or protrusion on the neck would constitute a screws means for engaging the screw cap and the corresponding screw means for engaging the container would be a helical groove on the inner wall of the depending flange of the screw cap (or even another helical thread on the cap) matching the screw means on the neck. As shown in FIG. 4, the helical thread on the neck 9, will mesh with the corresponding screw means of the cap 42, which corresponding screw means is a helical groove which matches the helical thread of the neck 9. Usually, the depending annular flange of the screw cap 42 will have the corresponding screw means for engaging the container 7.

The screw cap 42 includes an inwardly directed circumferential bead 17 which engages the peripheral lip 18 of the container 7 when the screw cap 42 is screwed onto the container 7. Preferably, the screw means for engaging the screw cap 42 is located on the neck between the rim 10 and the peripheral lip 18 of the container 7. Thus, the corresponding screw means of the depending annular flange of the screw cap 42, is located between the top 13 and the inwardly directed circumferential bead 17. The screw cap 42 also has a first outwardly directed circumferential bead located below the top 13, which first outwardly directed bead cooperates with a second outwardly directed circumferential bead 43 to define a circumferential locking groove extending around the outer side of said flange.

Thus the screw cap 42 is substantially similar to the snap cap 12 except that the screw cap 42 has a corresponding screw means for enegaging the container 7, whereas, the snap cap 12 has no corresponding screw means. Furthermore, the screw cap 42 has a second outwardly directed circumferential bead 43 for forming the upper end of the locking groove, whereas, the snap cap 12 has no second outwardly directed circumferential bead (as the cap 12 uses the outwardly projecting radial flange 16 of the top 13 for providing such upper end). The rotary safety ring 14 is modified to work with the screw cap 42, but in all respects has all the components described above, including an annular sidewall 23 surrounding the flange 15 and overlying the locking groove 31 and has fingers 30 which project into the locking groove 31, such fingers being attached to the inside wall of the annular sidewall 23. Furthermore, the fingers 30 pass through longitudinally extending release grooves located in the screw cap 42 as the fingers 30 do for the snap cap 12.

In all other respects, the safety closure having the screw cap 42 is identical to the safety closure for the snap cap described above.

In accordance with the present invention, the tear tabs 40 may be attached to the neck of the container having the screw cap 42. As shown in FIG. 4, a tear tab 40 is attached below the rotary safety ring of a container having a screw cap 42. This tear tab is identical to the tear tab described above for the container having the snap cap.

The snap cap (or screw cap) safety closures which utilize the tear tab feature, may be made further tamper resistant by including a tear pin which is connected to the cap and to the safety ring. As shown in FIGS. 4, 5, 7, 8, 9, 11, and 12, a tear pin 70 is connected to the snap cap 12 and is connected to the safety ring 14. Since the tear pin joins the cap and ring, the cap and ring can no longer be unlocked without breaking the pin. The pin is made so that it can be broken; preferably, the pin 70 is made so that the attachment to either the cap or the ring will be broken when the ring is rotated into alignment with the cap.

Generally the tear pin is constructed so that its length is approximately equal to the length of the annular sidewall. The tear pin 70 includes a main body which preferably extends longitudinally and a first attachment on one end of the main body, the first attachment fixing the pin to the cap. The tear pin 70 also includes a second attachment on the other end of the main body, which attachment fixes the pin to the ring. The tear pin could fix the cap and ring in a position of alignment, but preferably, the tear pin should fix the cap and the ring out of alignment. Of course, the tear pin need not be associated with the alignment. It is also preferable that the tear pin tear when the ring is rotated into alignment with the cap. Thus, any tampering with the ring or cap will be evidenced by the torn tear pin. Preferably, there should be two or several tear pins on the closure.

In accordance with the present invention, the tear pin 70 may be used on a screw cap closure utilizing the screw cap and safety ring assembly. As shown in FIG. 4, the tear pin 70 is attached to the screw cap 42 and is also attached to the rotary safety ring 14. Again, the pin is made so that it will be broken when one attempts to unscrew the cap or push the ring downwardly away from the cap. Preferably, the tear pin will be broken by rotating the rotary safety ring relative to the screw cap.

This invention also provides a tamper resistant and tamper evident closure having a modifed snap cap. As illustrated in FIGS. 13, 14, 15 and 16, a snap cap 166 has a top 167 overlying the mouth and rim 162 of the container 161. The rim 162 defines an open mouth, and the container 161 has a neck 164 located below the rim 162. The container may also be provided with a peripheral lip 165 around the rim, which peripheral lip 165 would engage an inwardly directed circumferential bead 169 on the depending annular flange 168 of the cap 166. The safety closure 160 includes the snap cap 166 and an outwardly directed wing 171 protruding through a slot 170 appearing in the depending annular flange 168 which projects from the top 167.

Figure 15:
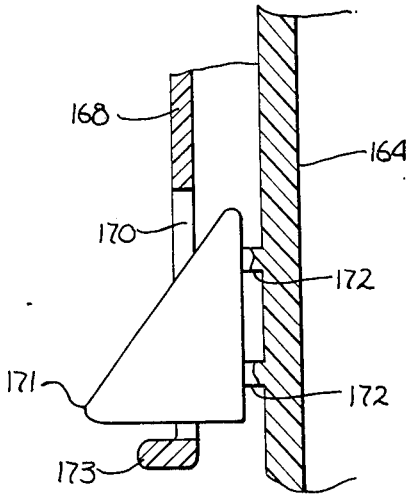
FIG. 15 is an enlarged cross-sectional view of the area around the wing 171 of the safety closure 160.
Figure 16:
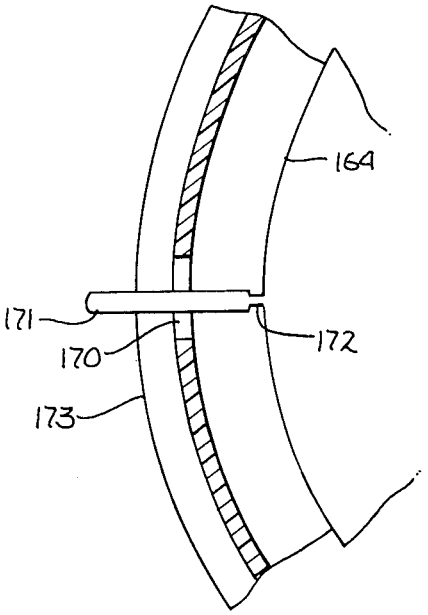
FIG. 16 is an enlarged view, from above the wing 171, of the wing 171 of the safety closure 160.

The depending annular flange 168 of the snap cap 166 overlies a portion of the neck 164 and has a slot 170. The outwardly directed wing 171 is attached to the neck 164 and protrudes through the slot 170. The outwardly directed wing 171 is completely surrounded by the slot. As used herein, the bottom edge of the slot means the upper edge of the wall forming the bottom edge of the slot; thus, as shown in FIG. 15, the bottom edge of the slot is formed by the ridge 173 located on the bottom of the depending annular flange 168. The bottom edge of the slot will always abut the bottom edge of the wing when one attempts to remove the snap cap 166. The wing 171 is attached to permit the wing to be sheared off the neck by an abutting force applied to the wing. Preferably, the wing 171 is connected to the neck 164 by a fragile rod 172. The fragile rod 172 is fragile enough that an abutting force applied to the wing 171 will shear the wing off the neck 164. Since the bottom edge of the slot will always abut the bottom edge of the wing when one attempts to remove the cap, the cap cannot be removed without applying an abutting force to said wing, thereby shearing said wing off the neck 164. The cap cannot be removed without shearing off the wing. Thus, if the consumer is informed of the function of the wing, then the consumer will know that the missing wing will indicate that the container has been tampered with. The wing 171 also provides resistance to one first opening the closure. Preferably, the slot 170 is closely matched to the perimeter of the outwardly directed wing 171. Thus, any upward or downward movement of the cap will place an abutting force on the wing 171. Furthermore, the longitudinal edges of the slot will tend to support the wing from horizontal forces which are usually applied to the container when it is handled (e.g., in packaging). Indeed, the wing 171, if sufficiently "protected" by the perimeter of the slot, can generally be removed only by lifting off the cap.

Preferably, the attachment of the wing is sturdy enough that normal handling of the container will not break off the outwardly directed wing 171. Thus, the fragile rod 172 must be strong enough that it will resist being broken off by normal handling of the container, but the fragile rod 172 will be fragile enough to permit the wing to be sheared off the neck when an abutting force is applied as when the cap is attempted to be removed. As shown in FIG. 15, two pegs 172 are used to attach the wing to the neck. The peg 172 is part of the neck. Other forms of attachment could be used; for example, a long, thin slice of material could attach the wing 171 to the neck 164 rather than two pegs 172. Such a long thin slice of material could extend the entire length of the portion of the wing 171 juxtaposed to the neck 164.

Preferably, the present invention should include an additional outwardly directed wing attached to the neck of the container 161. This additional outwardly directed wing protrudes through an additional slot appearing in the depending annular flange 168. As before, the additional slot completely surrounds the additional outwardly directed wing.

This invention also provides a tamper evident and tamper resistant closure for a screw cap. In FIGS. 17, 18, 19, 20 and 21, a safety closure 130 for a container 131 is illustrated; the container 131 has a neck 132 located below the rim of the container and has a screw means 133 for engaging a screw cap. The screw cap 134 has a corresponding screw means 137 to engage the container 131. As described above, the screw means for engaging the screw cap, being well known in the art, could include a helical thread (i.e., a helical, winding protrusion) around the neck of the container 131, or a helical groove in the neck 132 of the container 131. The corresponding screw means 137 on the cap 134, in order to engage the screw means 133 on the neck of the container 131 would be, in the case of the helical thread on the neck, a helical groove which matches the helical thread of the neck. Similarly, if the screw means on the neck is a helical groove, the corresponding screw means 137 on the screw cap 134 is a helical thread. In any case, the corresponding screw means on the screw cap is sized and matched to fit the screw means for engaging the screw cap located on the container 131. As shown in FIG. 18, the screw means 133 is an outwardly projecting helical thread, and the corresponding screw means 137 is an outwardly projecting helical thread, sized and matched to fit the screw means 133.

The screw cap 134 has a top 135 which overlies the mouth and the rim of the container 131. The screw cap 134 also has a depending annular flange 136 which projects below the top 135. The corresponding screw means 137 is located on the inside portion of the depending annular flange 136. The depending annular flange 136 also has a bottom edge which has an engaging surface 139.

This engaging surface is designed to meet a projecting member 143 which extends from the neck of the container. The engaging surface is juxtaposed to the projecting member 143 when the screw cap is fully screwed on. The projecting member 143 is positioned on the neck of the container to prevent the screw cap from being screwed off without causing the engaging surface to abut the projecting member and thereby apply a force on the projecting member. Since the screw cap cannot be removed without applying a force on the projecting member, the projecting member provides resistance to removal of the cap. Furthermore, only by breaking off the projecting member can the screw cap be removed.

The projecting member is attached to the neck so that a force applied to the projecting member will shear the projecting member off the neck. Thus, a fragile shaft 144 connects the projecting member 143 to the neck. One end of the fragile shaft 144, being part of the neck, is connected to the neck and the other end of the fragile shaft 144 is connected to the projecting member. The fragile shaft 144 is thin enough and fragile enough that a force applied to the projecting member will shear the projecting member off the neck. Of course, the fragile shaft 144 should be made strong enough so that the projecting member will not shear off the container during normal handling of the container. The projecting member 143 and the engaging surface 139 may be designed so that when the screw cap is initially screwed on, the projecting member will not be sheared off.

The bottom edge of the depending annular flange 136 may have several kinds of engaging surfaces 139. It is preferable that the engaging surface be a sawtooth bottom edge 138 which has at least one tooth 145. The projecting member 143 has a portion thereof juxtaposed to the tooth 145 of the sawtooth bottom edge 138. At least a portion of the projecting member 143 is located above the lowest portion of the tooth 145. As illustrated in FIG. 19, a portion of the tooth 145 will always abut a portion of the projecting member 143 when the screw cap 134 is attempted to be removed from the container 131. As illustrated in FIG. 17 and 19, the longitudinally extending edge 139 (vertical portion) will approach the vertical edge of the projecting member 143 as one turns the cap 134 to screw it off. Thus, the cap 134 may not be screwed off without causing the vertical portion 139 of the tooth 145 to abut (and thereby apply a substantially horizontal force to) the projecting member 143. As noted above, the projecting member 143 will shear off the neck 132 when a sufficiently strong force is applied to the projecting member. In accordance with this invention, one must turn the screw cap 134 hard enough to shear the projecting member 143 off the neck.132 in order to open the safety closure 130. In short, the screw cap 134 cannot be removed without shearing off the projecting member 143. Thus, the closure is both tamper evident and tamper resistant.

It is possible to have various styles of teeth. As illustrated in FIGS. 22*a* and 22*b*, the engaging surface of the tooth 145 may have various geometries. For example, referring to FIG. 19, the engaging surface 139 of the tooth 145 is the vertical portion 139. As illustrated in FIG. 22*a*, the engaging surface is the diagonal portion 141 of the tooth 145. Finally, as illustrated in FIG. 22*b*, the engaging surface could be a notch 200 in which the projecting member 143 is positioned. Referring to FIG. 19, the sawtooth bottom edge 138 has several teeth each of which has a vertical portion 139, a horizontal portion 140, and a diagonal portion 141. The projecting member 143 has a triangular vertical cross section having a vertical edge and a diagonal edge. The vertical edge of the projecting member is juxtaposed substantially parallel to the vertical portion 139 of the tooth 145 of the sawtooth bottom edge 138. The diagonal edge of the projecting member is juxtaposed substantially parallel to the diagonal portion 141 of the tooth 145 of the sawtooth bottom edge 138. As shown in FIG. 17, if the cap screws off in a counterclockwise direction (viewing the container from above the cap), then the sawtooth bottom edge 138 will cause the vertical portion 139 to abut the vertical edge of the projecting member when the screw cap 134 is unscrewed (screwed off). Keeping the same arrangement in mind, when the screw cap is screwed on, as it is in the manufacturing process, the diagonal portion 141 of the sawtooth bottom edge 138 may abut the diagonal edge of the projecting member (thereby applying a substantially downwardly vertical force). If the sawtooth bottom edge has teeth which completely surround the bottom edge of the depending annular flange 136, then assembly of the container and screw cap will be simplified since no special alignment of the cap on the container is necessary in the assembly process.

An outwardly directed spur 142, as shown in FIGS. 17, 18, 19 and 20, may be included in the safety closure 130 in accordance with this invention. The outwardly directed spur 142 projects from the neck 132 and is located below the projecting member 143 and is also located below the lowest portion of the sawtooth bottom edge 138 when the screw cap is fully secured to the container (i.e. fully screwed on). The spur 142 is positioned closely below the projecting member 143. Typically, for example, the spur is placed within a one-half millimeter of the bottom edge of the projecting member. This spur 142 functions to keep the projecting member on the neck when a downward force is placed on the projecting member, such as a downward force caused by the screw cap when the screw cap is placed on in the manufacturing process. Thus, the spur is positioned closely below the projecting member so that the spur will support the projecting member when downward forces are placed on the projecting member. If the safety closure illustrated in FIG. 17 is used, the screw cap can be easily placed on in the manufacturing process because the projecting member will be supported against downward forces caused by the screw cap when the cap is screwed on. It is noteworthy that the diagonal portion 141 will apply a substantially downward force on the projecting member when the cap is screwed on. When the cap, from the fully screwed on position, is unscrewed, the vertical portion 139 of the tooth 145 will abut the vertical edge of the projecting member and thereby apply a substantially horizontal force on the projecting member; hence, the spur 142 will not support the projecting member when the cap is unscrewed but will support the projecting member when the cap is screwed on. Thus, assembling this closure (i.e., placing the cap on in the manufacturing process) is easier with the spur 142.

In summary, the tear tab 40, the tear pin 70, the wing 171, and the projecting member 143 make the closures disclosed herein both tamper evident and tamper resistant because their removal is required before the closures can be opened; hence, a missing wing will indicate that the closure has been tampered with. Furthermore, all these components provide resistance against the first opening of the closures; hence, the consumer can also notice tampering when the closures are first opened without any resistance. The tear tab 40, the tear pin 70, the wing 171, and the projecting member 143 are particularly well suited to be constructed out of polyethylene, polystyrene or aluminum since these materials allow protrusions (such as the tear tabs) to be breakable (and hence removable). Furthermore, these materials are well suited for making the containers. These containers may be made by standard methods, well known in the prior art, of plastic and metal container fabrication.

While a particular form of the invention has been illustrated and described, it will be apparent that other modifications can be made without departing from the spirit and scope of the invention.

We claim:

1. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said cap;

a plurality of angularly spaced fingers on the inner side of said sidewall projecting into said locking groove and overlying the bottom wall of said locking groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to the cap, thereby normally preventing downward movement of said ring out of overlying relation with said locking groove;

a plurality of longitudinally extending release grooves in said first outwardly directed circumferential bead, spaced and sized to permit movement of said fingers through said first outwardly directed circumferential bead in one angular position of said ring about said cap, and thus allowing downward movement of said ring away from said cap for the removal of the latter from the container in said one angular position; and at least one tear pin being attached to said cap and to said ring, said pin being constructed so that it may be broken and being attached so that said closure cannot be opened without breaking said pin, whereby said closure cannot be opened without breaking said pin.

2. A safety closure as defined in claim 1, wherein said pin may be broken by rotating said cap relative to said ring.

3. A safety closure as defined in claim 2, wherein said pin comprises:

a main body;

a first attachment on one end of said main body, said first attachment fixing said pin to said cap;

a second attachment on the other end of said main body, said second attachment fixing said pin to said ring;

and wherein said pin fixes said cap and said ring out of alignment, whereby said cap and said ring cannot be aligned without breaking said pin.

4. A safety closure for a container having a rim defining a mouth, a neck located below said rim, a peripheral lip around said neck, and a screw means for engaging a screw cap, said closure comprising:

said screw cap having a top overlying said mouth and said rim, and having a depending annular flange projecting below said top, said depending annular flange having a corresponding screw means for engaging said container and having an inwardly directed circumferential bead engaged below said lip and having a first outwardly directed circumferential bead located below said top and a second outwardly directed circumferential bead located above said first outwardly directed circumferential bead and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said screw cap;

a plurality of anguarly spaced fingers on the inner side of said sidewall projecting into said locking groove and overlying the bottom wall of said locking groove to prevent downward movement of said ring along said cap, said fingers being inclined inwardly and downwardly into said locking groove and having free inner ends positioned to be wedged against the bottom of the locking groove to prevent free flexing of the fingers as the ring is pulled downwardly relative to said screw cap, thereby normally preventing downward movement of said ring out of overlying relation with said locking groove;

a plurality of longitudinally extending release grooves in said first outwardly directed circumferential bead, spaced and sized to permit movement of said fingers through said first outwardly directed circumferential bead in one angular position of said ring about said cap, and thus allowing downward movement of said ring away from said cap for the removal of the latter from the container in said one angular position; and at least one tear pin being attached to said cap and to said ring, said pin being constructed so that it may be broken and being attached so that said closure cannot be opened without breaking said pin, whereby said closure cannot be opened without breaking said pin.

5. A safety closure as defined in claim 4, wherein said pin may be broken by rotating said cap relative to said ring.

6. A safety closure as defined in claim 5, wherein said pin comrpises:

a main body;

a first attachment on one end of said main body, said first attachment fixing said pin to said cap;

a second attachment on the other end of said main body, said second attachment fixing said pin to said ring;

and wherein said pin fixes said cap and said ring out of alignment, whereby said cap and said ring cannot be aligned without breaking said pin.

* * * * *